US008353125B2

(12) United States Patent
Riley

(10) Patent No.: US 8,353,125 B2
(45) Date of Patent: Jan. 15, 2013

(54) METHOD OF ADJUSTABLY MOUNTING A DEVICE TO A FIREARM RAIL INTERFACE AND MOUNTING APPARATUS THEREFOR

(75) Inventor: Louis F. Riley, Weston, FL (US)

(73) Assignee: GAMO Outdoor USA Inc., Ft. Lauderdale, FL (US)

( * ) Notice: Subject to any disclaimer, the term of this patent is extended or adjusted under 35 U.S.C. 154(b) by 214 days.

(21) Appl. No.: 13/009,363

(22) Filed: Jan. 19, 2011

(65) Prior Publication Data

US 2012/0168589 A1 Jul. 5, 2012

Related U.S. Application Data

(60) Provisional application No. 61/296,408, filed on Jan. 19, 2010.

(51) Int. Cl.
*F41G 1/00* (2006.01)
*F41G 1/387* (2006.01)
*F16M 13/02* (2006.01)

(52) U.S. Cl. ..... 42/90; 42/124; 42/125; 248/315

(58) Field of Classification Search ..... 42/90, 124, 42/125, 126, 127, 128; 89/37.04; 248/315
See application file for complete search history.

(56) References Cited

U.S. PATENT DOCUMENTS 3,276,127 A * 10/1966 Abrahamson ..... 42/125
3,513,549 A * 5/1970 Smiley ..... 42/126
3,611,606 A * 10/1971 Sefried et al. ..... 42/124
3,835,565 A * 9/1974 Weast ..... 42/90
4,205,473 A * 6/1980 Wilson ..... 42/127
4,310,980 A * 1/1982 Pilkington ..... 42/127
4,756,111 A * 7/1988 Lapier ..... 42/128
4,776,126 A * 10/1988 Williams ..... 42/125
4,873,779 A * 10/1989 Ellison et al. ..... 42/124
5,086,566 A 2/1992 Klumpp
5,425,191 A * 6/1995 Taylor et al. ..... 42/124
5,428,915 A 7/1995 King
5,546,691 A * 8/1996 Allison ..... 42/90
5,680,725 A * 10/1997 Bell ..... 42/127
5,694,712 A * 12/1997 Plonka ..... 42/124
6,722,074 B1 * 4/2004 Farrell ..... 42/124
7,543,405 B1 6/2009 Ivey
8,020,335 B2 * 9/2011 Larsson et al. ..... 42/125
2004/0216352 A1 * 11/2004 Wooten et al. ..... 42/127
2005/0241212 A1 * 11/2005 Swan ..... 42/127
2006/0010758 A1 * 1/2006 Zeh ..... 42/124
2007/0266611 A1 * 11/2007 Stover ..... 42/124
2009/0133311 A1 * 5/2009 Hollenbach et al. ..... 42/124
2009/0307956 A1 12/2009 Barret
2010/0043271 A1 * 2/2010 Williams et al. ..... 42/124

* cited by examiner

*Primary Examiner* — Bret Hayes
(74) *Attorney, Agent, or Firm* — Hartman Global IPLaw; Gary M Hartman; Domenica N. S. Hartman

(57) ABSTRACT

A mounting apparatus and method for adjustably mounting, for example, an optical device to a rail interface of a firearm. The apparatus includes a base, a ring assembly configured to surround and grip the device, and at least two spacer members configured to be disposed and secured between the base and ring assembly. The ring assembly includes ring segments, a mechanism for securing the ring assembly to the base, and a mechanism for securing the ring segments together to grip the device therebetween. One of the ring segments has a support surface having a shape complementary to a support surface of the base. The spacer members are configured to be secured between the base and ring assemblies, and each spacer member has oppositely-disposed support surfaces configured to complementarily engage the support surface of either the base or ring assembly.

24 Claims, 3 Drawing Sheets

METHOD OF ADJUSTABLY MOUNTING A DEVICE TO A FIREARM RAIL INTERFACE AND MOUNTING APPARATUS THEREFOR

CROSS REFERENCE TO RELATED APPLICATIONS

This application claims the benefit of U.S. Provisional Application No. 61/296,408, filed Jan. 19, 2010, the contents of which are incorporated herein by reference.

BACKGROUND OF THE INVENTION

The present invention generally relates to hardware of the type adapted to mount devices to a rail interface, for example, of the type provided on a firearm, stand or tripod. More particularly, the present invention relates to a mounting apparatus adapted to mount a device, for example an optical device, to a rail interface of a firearm so as to enable adjustment of the height of the device relative to the rail interface.

Optical devices such as scopes, telescopes, monoculars, and sighting and aiming devices are commonly mounted to firearms, including rifles, shotguns, pistols and archery bows. These devices are preferably mounted so that their position relative to the firearm is maintained and remains stable during use of the firearm. A variety of hardware is commercially available for mounting optical devices to firearms, with most being adapted for use with a standardized rail interface, for example, a Picatinny-type rail interface (MIL-STD M1913), a Weaver-type rail interface, or a variation or adaptation of these, such as the NATO STANAG 2324 rail interface. These rail interfaces are similar, in that each defines a pair of parallel longitudinal rails (continuous or discontinuous) and slots that extend laterally between the rails and are spaced longitudinally along the length of the rail interface. These interfaces differ primarily by the width and spacing of their slots.

The sizes of devices that can be mounted to a rail interface vary widely, as do the optimal positions of the devices relative to the firearm and, therefore, the rail interface. For example, commercially available scopes typically have objective lenses in a range from 32 to about 56 mm, which significantly affects the position that will likely be suitable for the device on a firearm. In addition, firearm users typically position an optical device based upon the individual preferences of the user and the particular circumstances involved in the intended application or use of the device or firearm. For example, an optical scope might be positioned on the same firearm differently by two individuals based simply on differences in their physical characteristics. Also, users may wish to use multiple different devices on a single firearm, and such devices will likely have different sizes, shapes, and other characteristics associated with their use.

The substitution of one device for another on a firearm conventionally involves the use of different hardware to mount each device, while no modifications are typically available if the same firearm and device are used by different individuals. Therefore, it would be desirable if mounting hardware were capable of allowing for a range of adjustments between a firearm rail interface and one or more devices that one might be mounted to the firearm. However, such an adjustment capability should also provide stability so that the position of a device can be maintained and remain stable during use of the firearm.

BRIEF DESCRIPTION OF THE INVENTION

The present invention provides a mounting apparatus and method of using the apparatus to mount a device, such as an optical device, to a rail interface of, for example, a firearm, so that the position (height) of the device can be adjusted relative to the rail interface.

According to a first aspect of the invention, the mounting apparatus includes a base assembly, a ring assembly configured to surround and grip the device, and at least two spacer members configured to be disposed and secured between the base and the ring assembly. The base assembly includes a base, a first securing means for releasably securing the mounting apparatus to the rail interface of the firearm, and a base support surface oppositely-disposed on the base relative to the first securing means. The ring assembly includes first and second ring segments, a second securing means for releasably securing the ring assembly to the base, and a third securing means for releasably securing the first and second ring segments together and gripping the device therebetween. Each of the first and second ring segments has a cradle surface configured to engage the device. The first ring segment further has a ring support surface oppositely-disposed relative to the cradle surface thereof, and the ring support surface has a shape complementary to the base support surface of the base. The spacer members are configured to be secured between the base and ring assembly with the second securing means. Each spacer member has a first support surface configured to engage the base support surface of the base, and a second support surface oppositely-disposed on the spacer member relative to the first support surface thereof. The first support surface has a shape complementary to the base support surface of the base, and the second support surface has a shape complementary to the ring support surface of the first ring segment.

Another aspect of the invention is a method of using a mounting apparatus comprising the elements described above. Such a method includes releasably securing the base to the rail interface using the first securing means, installing at least one of the spacer members on the base so that the first support surface of the at least one spacer member complementarily engages the base support surface of the base, installing the first ring segment of the ring assembly on the at least one spacer member so that the ring support surface of the first ring segment complementarily engages the second support surface of the at least one spacer member, releasably securing the first ring segment of the ring assembly to the base using the second securing means, placing the device on the cradle surface of the first ring segment, and gripping the device with the ring assembly by securing the second ring segment to the first ring segment using the third securing means.

A technical effect of the invention is the ability to substitute one device for another on a firearm while using the same mounting apparatus, as well as to allow the position of the same device to be modified if the firearm and device are used by different individuals. The mounting apparatus allows for a range of adjustments between a firearm rail interface and one or more devices of the type that one might mount to the firearm. The adjustment capability provided by the mounting apparatus does not degrade the stability of the apparatus or device, in that the apparatus is able to maintain the position of a device during a wide range of uses of the firearm. Such capabilities are made possible in part by the spacer members, which can be precision manufactured to different thicknesses, allowing the spacer members to be selectively used to cover a range of precision adjustments.

Other aspects and advantages of this invention will be better appreciated from the following detailed description.

DETAILED DESCRIPTION OF THE INVENTION

Figure 1:
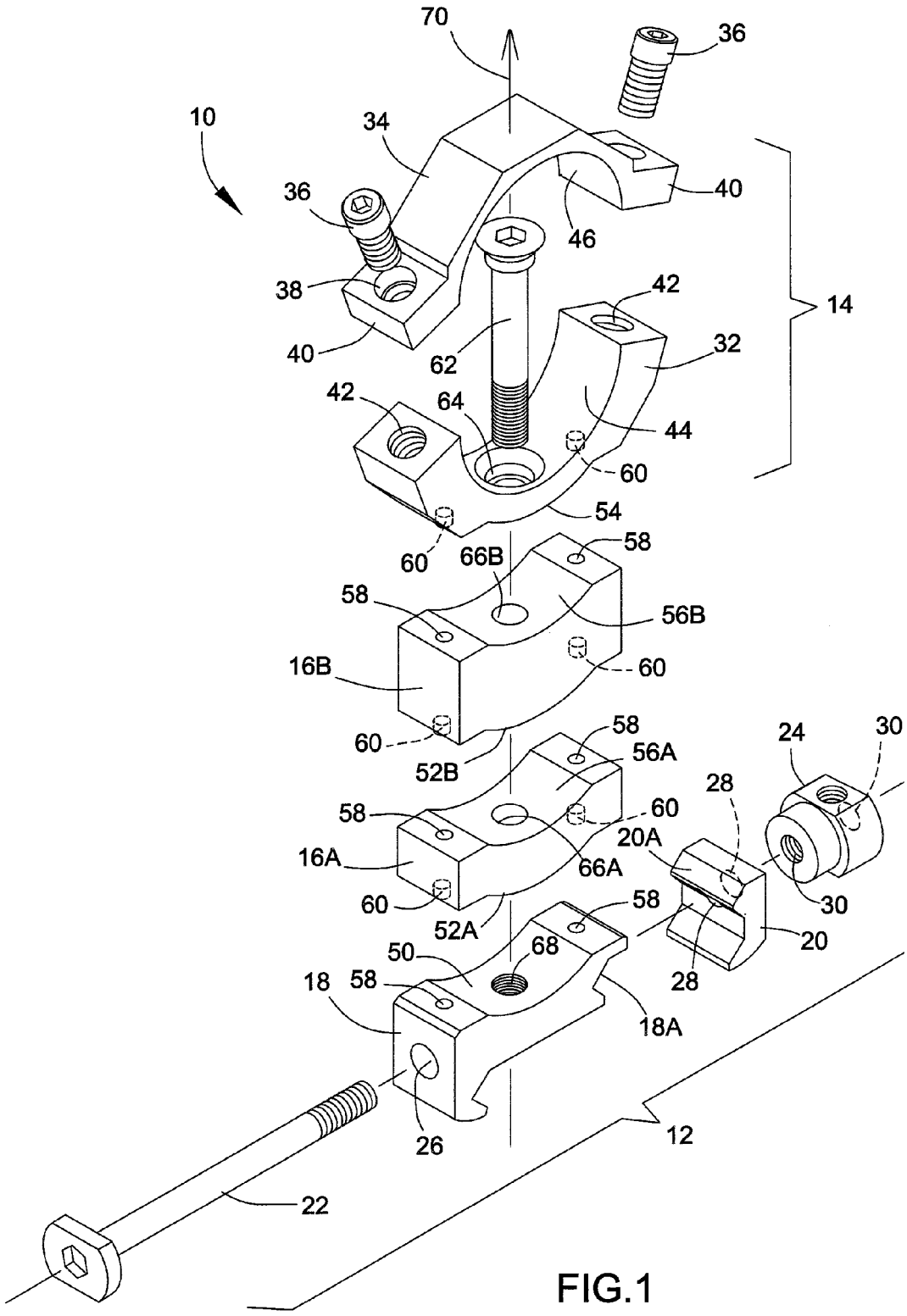
FIGS. 1 and 2 are exploded views of mounting apparatuses in accordance with first and second embodiments of this invention.
Figure 2:
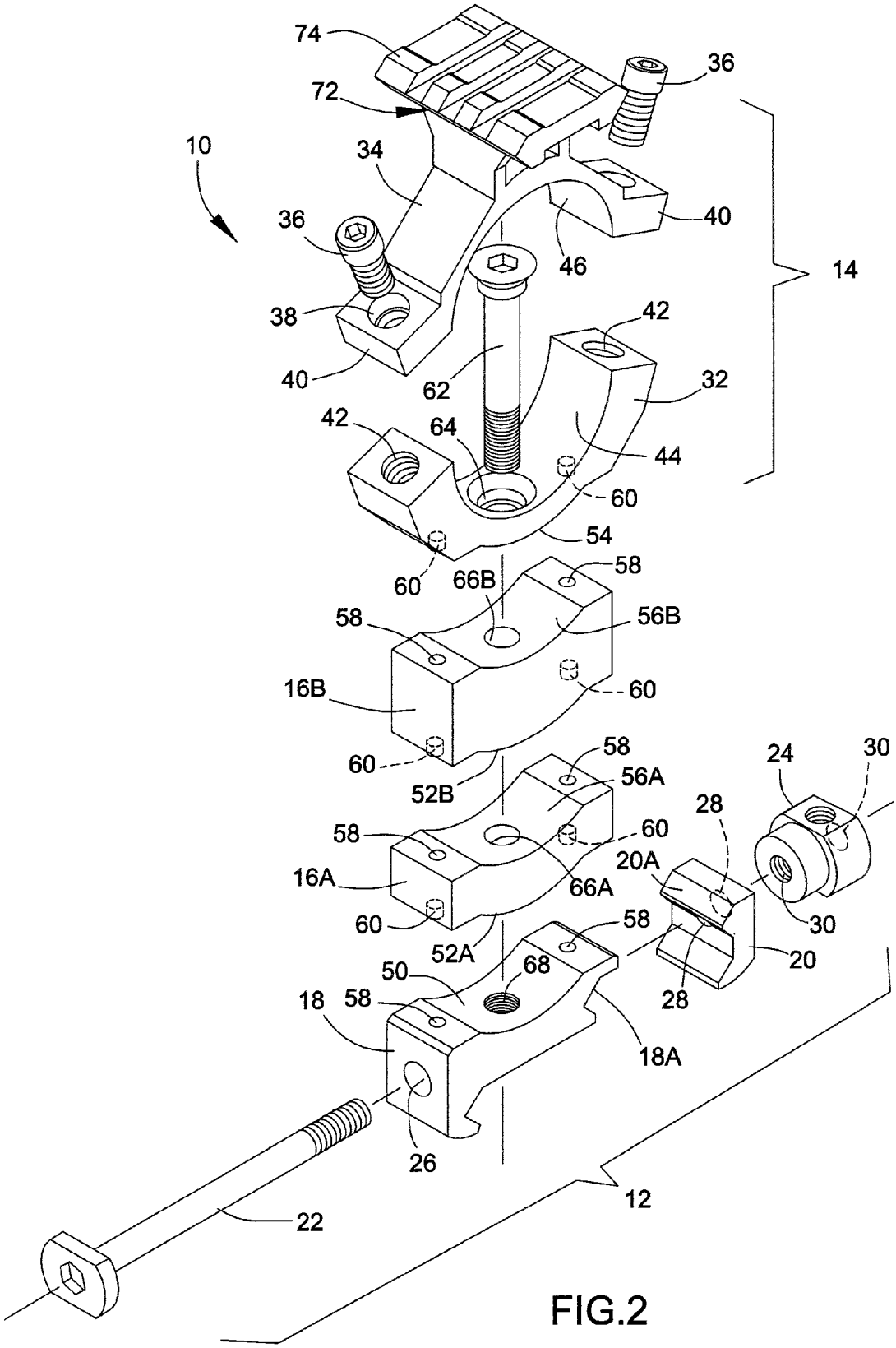
Figure 3:
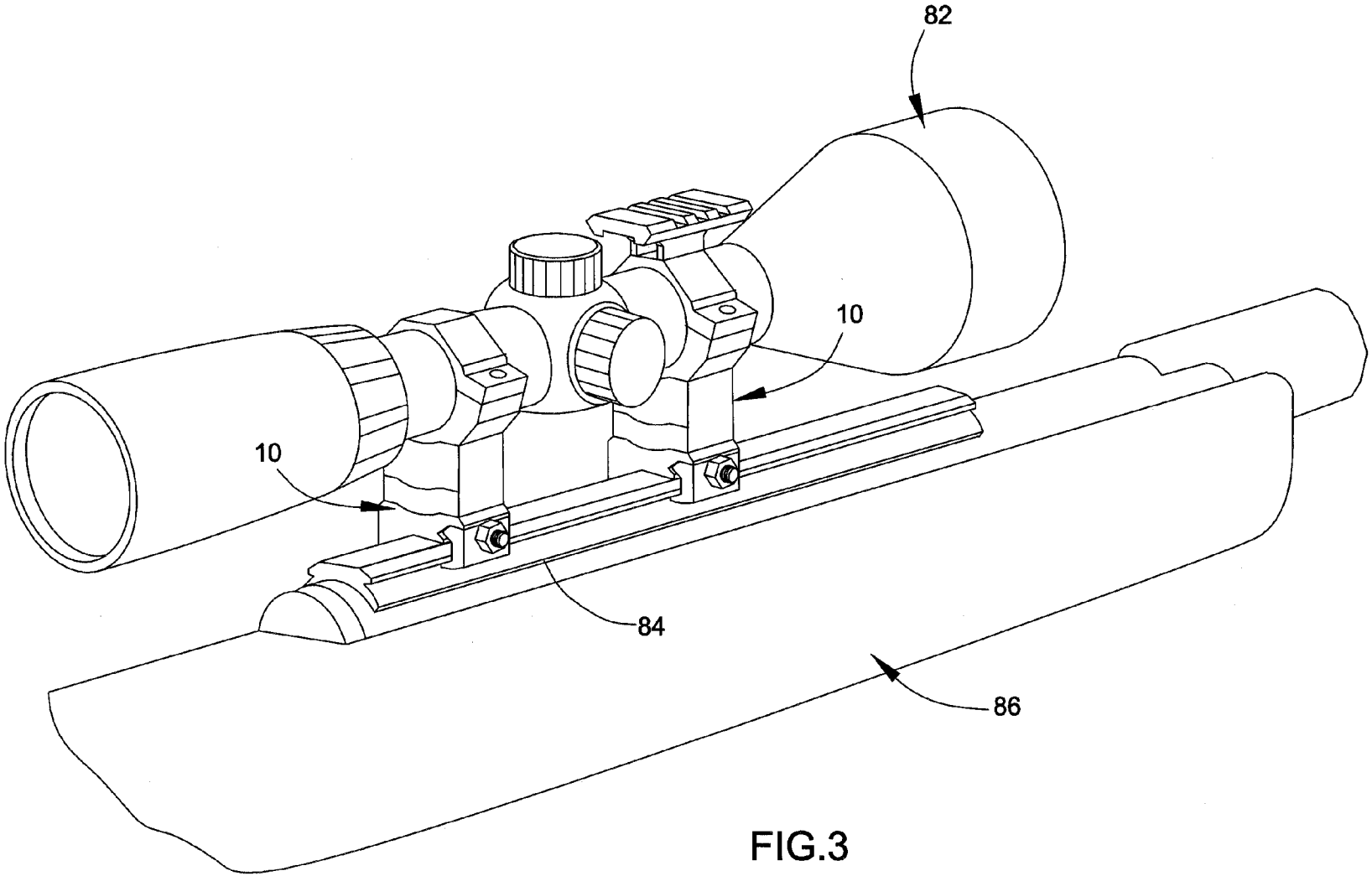
FIG. 3 represents the mounting apparatuses of FIGS. 1 and 2 mounted on a rail interface of a firearm.

FIGS. 1 through 3 represent two embodiments of a mounting apparatus that incorporate certain preferred aspects of the invention. As evident from FIGS. 1 through 3, each mounting apparatus comprises multiple components that can be assembled as desired based upon individual preferences of the user and the particular configuration of the device mounted with the apparatus. The invention will be particularly described in reference to mounting a scope to a rifle, as represented in FIG. 3. The mounting apparatuses of this invention are equally well suited for mounting a variety of other optical devices, including but not limited to telescopes, monoculars, and sighting and aiming devices, and to other types of firearms and equipment, including but not limited to shotguns, pistols and archery bows. Furthermore, the invention will be described in reference to mounting devices to a standardized rail interface, for example, a Picatinny-type rail interface, a Weaver-type rail interface, or a variation or adaptation of these, though other types of rail interfaces are also within the scope of the invention. Finally, it should be apparent that the teachings of the invention can be applied to a variety of other applications, including mounting various types of devices to rail-type structures.

As represented in FIG. 1, a first mounting apparatus, hereinafter referred to as a mount 10, includes a mounting base assembly 12, a ring assembly 14 and multiple individual spacers 16A and 16B. While two spacers 16A and 16B are shown, it is within the scope of the invention that more spacers could be employed by the mount 10.

The base assembly 12 includes a base 18 and a locking mechanism comprising a clamp 20, cross bolt 22, and thumb nut 24. The bolt 22 is sized to pass through a hole 26 in the base 18, a hole 28 in the clamp 20, and a threaded hole 30 in the nut 24, by which the base 18 can be secured to a rail interface (not shown) of a firearm. The clamp 20 defines a lobe 20A that is complementary in shape to a slot or notch 18A defined in the base 18.

The ring assembly 14 includes a saddle 32, a mounting cap 34, and bolts 36 for securing the mounting cap 34 to the saddle 32. The saddle 32 and cap 34 are configured as two segments of a ring adapted to surround and grip a scope or other optical device (not shown). The bolts 36 are adapted to secure the cap 34 to the saddle 32 by passing through holes 38 in a pair of flanges 40 of the cap 34, and threading into threaded holes 42 in the saddle 32. Each of the saddle 32 and cap 34 comprise a cradle surface 44 and 46, respectively, that face each other and are configured to engage and grip the optical device therebetween. While the cradle surfaces 44 and 46 are represented as being adapted to completely surround a device, it is foreseeable that the saddle 32 and cap 34 could be configured so that their surfaces 44 and 46 surround and engage only portions of a device, yet still secure the device with a clamping action.

The base 18, saddle 32 and spacers 16 are all represented as having complementary support surfaces. In particular, the base 18 and spacers 16A and 16B are represented as having surface regions that define concave support surface 50, 52A and 52B, respectively, and the saddle 32 and spacers 16A and 16B are represented as having surface regions that define convex support surfaces 54, 56A and 56B, respectively. The concave support surfaces 50, 52A and 52B are all complementary in shape and size to the convex support surfaces 54, 56A and 56B, which enables the support surfaces 54, 56A and 56B of the saddle 32 and spacers 16A and 16B to nest within any of the support surfaces 50, 52A and 52B of the base 18 and spacers 16A and 16B. While the concave support surfaces 50, 52A and 52B are represented as being upper surfaces (as viewed in FIG. 1) of the base 18 and spacers 16A and 16B, and the convex support surfaces 54, 56A and 56B are represented as being lower surfaces (as viewed in FIG. 1) of the saddle 32 and spacers 16A and 16B, it is foreseeable that this arrangement could be reversed. Furthermore, the opposing surfaces of the spacers 16A and 16B, base 18, and saddle 32 are represented as being predominantly defined by their respective concave and convex support surfaces 50, 52A, 52B, 54, 56A and 56B, in other words, the concave and convex support surfaces 50, 52A, 52B, 54, 56A and 56B make up more than half of the opposing surfaces, though it is foreseeable that the size of the support surfaces 50, 52A, 52B, 54, 56A and 56B could be lesser or greater relative to the spacers 16A and 16B, base 18, and saddle 32. Finally, from FIG. 1 it can be seen that each of the support surfaces 50, 52A, 52B, 54, 56A and 56B has a constant curvature. However, it should be appreciated that more complicated surface forms could be employed.

The base assembly 12, ring assembly 14 and spacers 16A and 16B are configured to be held together with a threaded bolt 62 that passes down through holes 64, 66A and 66B in the saddle 32 and spacers 16A and 16B, respectively, and into a threaded hole 68 in the base 18. As a point of reference, this bolt 62 and holes 64, 66A, 66B and 68 will be described as aligned on an axis 70 that coincides with an adjustable mount direction 70 of the mount 10, corresponding to the height or distance that the ring assembly 14 is able to secure an object relative to a rail interface to which the base 18 is secured.

FIG. 1 further represents the opposing surfaces of the spacers 16A and 16B, base 18, and saddle 32 as being provided with complementary interlocking features. In particular, each of the spacers 16A and 16B and base 18 has a pair of blind holes 58 that are complementary in shape and size to posts 60 that protrude from the spacers 16A and 16B and saddle 32. The holes 58 and posts 60 are defined in lateral surfaces of the spacers 16A and 16B, base 18 and saddle 32 that are generally flat and perpendicular to the adjustable mount direction 70 of the mount 10, in contrast to the curved support surfaces 50, 52A, 52B, 54, 56A and 56B. When engaged with each other, the holes 58 and posts 60 prevent relative movement between the spacers 16A and 16B, base 18, and saddle 32, in particular, lateral (side-to-side as viewed in FIG. 1), fore-aft (as viewed in FIG. 1), roll and yaw. This stabilization of the spacers 16A and 16B, base 18 and saddle 32 relative to each other is in addition to the alignment provided by their complementarily-shaped support surfaces 50, 52A, 52B, 54, 56A and 56B.

As evident from FIG. 1, each spacer 16A and 16B has a thickness dimension defined by a distance between its support surfaces 52A and 56A or 52B and 56B. Furthermore, the thickness dimensions of the spacers 16A and 16B differ, with the spacer 16A being thinner than the spacer 16B. This aspect of the invention enables the spacers 16A and 16B to be selectively installed to provide at least four adjustment positions for the saddle 32 relative to the base 18, and therefore an optical device held by the ring assembly 14 relative to a rail interface to which the base 18 is mounted. In particular, the mount 10 can be installed without any spacer 16A or 16B, with only the thinner spacer 16A, within only the thicker spacer 16B, with both spacers 16A and 16B. This aspect of the invention provides for an adjustment range between the support surface 50 of the base 18 and the support surface 54 of the saddle 32. In a preferred embodiment, this range is about one inch (about 25 mm). As represented in FIG. 1, the thickness dimension of the spacer 16A is less than one-half of the thickness dimension of the spacer 16B. More particularly, the spacer 16A is about one-fourth the thickness of the spacer 16B. As an example, to achieve an adjustment range of about 25 mm, the spacer 16A may have a thickness dimension of about 5 mm and the spacer 16B may have a thickness dimension of about 20 mm. Based on these thicknesses, the adjustment range of the mount 10 would include adjustments of about 5 mm (with the spacer 16A only), about 20 mm (with the spacer 16B only), and about 25 mm (with both spacers 16A and 16B) beyond the baseline position in which saddle 32 is directly mounted on the base 18.

FIG. 2 depicts a second embodiment of a mounting apparatus of this invention. In FIG. 2, consistent reference numbers are used to identify the same or functionally equivalent elements as described for the embodiment of FIG. 1. In view of similarities between the first and second embodiments, the following discussion of FIG. 2 will focus primarily on aspects of the second embodiment that differ from the first embodiment in some notable or significant manner. Other aspects of the second embodiment not discussed in any detail can be, in terms of structure, function, materials, etc., essentially as was described for the first embodiment.

The mount 10 represented in FIG. 2 is shown as having a mounting base 72 formed as part of the mounting cap 34. The mounting base 72 can be configured as a rail interface that allows other devices (not shown), for example, a tactical weapon light, laser sights or even an additional mount 10 to be secured to the mount 10 through, for example, a rail clamping mechanism that may be similar to the base 18 and clamp 20 of the base assembly 12. The mounting base 72 is oppositely-disposed relative to the cradle surface 46 of the cap 34, such that its rail interface faces away from the ring assembly 14 as well as the remainder of the mount 10.

The mount 10 of FIG. 2 further differs from the mount 10 of FIG. 1 as a result of having interlocking features that differ from those of FIG. 1. In particular, the protruding features of the saddle 32 and spacers 16A and 16B are in the form of ribs 58, and recesses defined in the base 18 and spacers 16A and 16B are in the form of slots 60. It should be appreciated that various other forms of interlocking features, in the form of posts, holes, pins, ridges, grooves, bumps, recesses, or other surface features can be used in combination to provide a desired interlocking capability.

As evident from FIG. 3, the mounts 10 represented in FIGS. 1 and 2 can be used in combination to adjustably mount and position a scope 82 (or other device) to a rail interface 84 of a firearm 86. While FIG. 3 represents one of each type of mount (FIGS. 1 and 2) installed on the firearm 86, it is foreseeable that one or two of only one of the types of mounts 10 could be used. Generally speaking, the base 18 of each mount 10 can be releasably secured to the rail interface 84 using the clamping mechanism provided by the clamp 20, bolt 22 and nut 24 of the respective mount 10. Thereafter, each mount 10 can be assembled by installing (if desired) one of the spacers 16A/16B on its base 18 so that its support surface 56A/56B complementarily engages the support surface 50 of the base 18. The remaining spacer 16A/16B (as well as one or more additional spacers) may optionally be mounted in a similar manner, so that the support surface 56A/56B of each additional spacer 16A/16B is complementarily engaged with the support surface 52A/52B of the preceding spacer 16A/16B. Next, the ring assembly 14 for each mount 10 can be installed by placing the saddle 32 on the outermost spacer 16A/16B so that the support surface 54 of the saddle 32 complementarily engages the support surface 52A/52B of that spacer 16A/16B. The saddle 32 and any spacers 16A/16B are then simultaneously secured to the base 18 using the bolt 72, after which the scope 82 can be placed on the cradle surfaces 44 of the saddles 32, followed by installation of the caps 34 to surround and grip the device 82 between the cradle surfaces 44 and 46 of both sets of ring assemblies 14.

As discussed above, by manufacturing the spacers 16A and 16B to have different thickness dimensions, the mount 10 can be assembled and installed to provide a range of adjustment heights. For this purpose, the user may determine a desired adjustment height for the intended device (scope 82) relative to the firearm 86, and then select one, both or neither of the spacers 16A and 16B to attain the desired adjustment height. Typically, the same spacers 16A and/or 16B will be installed on both sets of mounts 10 used to secure the device 82 in order for the device 82 to be oriented approximately parallel to the barrel of the firearm 86.

In view of the above, it can be appreciated that the spacers 16A and 16B, base 18 and saddle 32 are adapted for ease of assembly, alignment, stability, and other desired characteristics of the mounts 10 of FIGS. 1 through 3. The components of each mount 10 can be precision machined from a variety of materials, including but not limited to steel or aluminum alloys, to provide for relatively precise height adjustments as well as precise nesting of the components, the latter of which promotes a stable assembly that avoids movement of the mount 10 during use, including recoil of the firearm on which the mount 10 is installed.

While the invention has been described in terms of specific embodiments, it is apparent that other forms could be adopted by one skilled in the art. For example, the physical configuration of the mounts 10 could differ from those shown, and materials and processes other than those noted could be used. Therefore, the scope of the invention is to be limited only by the following claims.

The invention claimed is:

1. A mounting apparatus for adjustably mounting and positioning a device to a rail interface of a firearm, the mounting apparatus comprising:

a base assembly comprising a base, a first securing means for releasably securing the mounting apparatus to the rail interface of the firearm, and a base support surface oppositely-disposed on the base relative to the first securing means;

a ring assembly configured to surround and grip the device, the ring assembly comprising first and second ring segments, a second securing means for releasably securing the ring assembly to the base, and a third securing means for releasably securing the first and second ring segments together and gripping the device therebetween, each of the first and second ring segments having a cradle surface configured to engage the device, the first ring segment having a ring support surface oppositely-disposed relative to the cradle surface thereof, the ring support surface having a shape complementary to the base support surface of the base; and at least two spacer members configured to be disposed between the base and the ring assembly and secured therebetween with the second securing means, each of the spacer members having first and second support surfaces oppositely-disposed relative to each other, the first support surfaces having a shape complementary to the base support surface of the base, the second support surfaces having a shape complementary to the ring support surface of the first ring segment.

2. The mounting apparatus according to claim 1, wherein each of the spacer members has a thickness dimension defined by a distance between the first and second support surfaces thereof, and the thickness dimension of a first of the spacer members is less than the thickness dimension of a second of the spacer members.

3. The mounting apparatus according to claim 2, wherein the first and second spacer members are adapted to be selectively installed and omitted from the mounting apparatus to provide at least four adjustment positions for the ring support surface relative to the base support surface.

4. The mounting apparatus according to claim 2, wherein the thickness dimension of the first spacer member is less than one-half of the thickness dimension of the second spacer member.

5. The mounting apparatus according to claim 2, wherein the thickness dimension of the first spacer member is about one-fourth of the thickness dimension of the second spacer member.

6. The mounting apparatus according to claim 2, wherein the thickness dimensions of the first and second spacer members provide an adjustment range of about twenty-five millimeters between the base support surface and the ring support surface.

7. The mounting apparatus according to claim 6, wherein the first and second spacer members are adapted to be selectively installed and omitted from the mounting apparatus to provide at least four adjustment positions for the ring support surface relative to the base support surface over the adjustment range.

8. The mounting apparatus according to claim 1, wherein the shape of each of the ring and first support surfaces is predominantly defined by a convex surface region, and the shape of each of the base and second support surfaces is predominately defined by a concave surface region.

9. The mounting apparatus according to claim 8, wherein each of the convex and concave surface regions has constant curvature.

10. The mounting apparatus according to claim 1, wherein each of the ring and first support surfaces has at least one protruding feature protruding therefrom, and each of the base and second support surfaces has at least one recess therein that is complementary to the protruding features of the ring and first support surfaces.

11. The mounting apparatus according to claim 10, wherein the protruding features of the ring and first support surfaces are posts and the recesses of the base and second support surfaces are blind holes.

12. The mounting apparatus according to claim 10, wherein the protruding features of the ring and first support surfaces are ribs and the recesses of the base and second support surfaces are slots.

13. The mounting apparatus according to claim 1, wherein the first securing means comprises a clamping assembly adapted to clamp onto the rail interface of the firearm.

14. The mounting apparatus according to claim 13, wherein the rail interface of the firearm is a Picatinny or Weaver rail interface.

15. The mounting apparatus according to claim 1, wherein at least one of the second and third securing means comprises a threaded bolt.

16. The mounting apparatus according to claim 1, wherein the second ring segment has a mounting base oppositely-disposed relative to the cradle surface thereof, the mounting base having a supplemental rail interface facing away from the ring assembly.

17. A method of adjustably mounting and positioning a device to a rail interface of a firearm using the mounting apparatus of claim 1, the method comprising:

releasably securing the base to the rail interface using the first securing means;

installing at least one of the spacer members on the base so that the first support surface of the at least one spacer member complementarily engages the base support surface of the base;

installing the first ring segment of the ring assembly on the at least one spacer member so that the ring support surface of the first ring segment complementarily engages the second support surface of the at least one spacer member;

releasably securing the first ring segment of the ring assembly to the base using the second securing means;

placing the device on the cradle surface of the first ring segment; and gripping the device with the ring assembly by securing the second ring segment to the first ring segment using the third securing means.

18. The method according to claim 17, wherein the step of releasably securing the first ring segment to the base simultaneously causes the second securing means to secure the at least one spacer member between the first ring segment and the base.

19. The method according to claim 17, wherein each of the spacer members has a thickness dimension defined by a distance between the first and first support surfaces thereof, and the thickness dimension of a first of the spacer members is less than the thickness dimension of a second of the spacer members, the method further comprising the steps of:

determining a desired adjustment height of the device relative to the firearm; and selecting the at least one spacer member so as to attain the desired adjustment height.

20. The method according to claim 19, wherein the thickness dimensions of the first and second spacer members provide an adjustment range for the adjustment height of about twenty-five millimeters.

21. The method according to claim 17, wherein the step of installing the at least one spacer member comprises:

installing a first of the spacer members on the base so that the first support surface of the first spacer member complementarily engages the base support surface of the base; and installing a second of the spacer members on the first spacer member so that the first support surface of the second spacer member complementarily engages the second support surface of the first spacer member;

and wherein the step of installing the first ring segment on the at least one spacer member comprises installing the first ring segment on the second spacer member so that the ring support surface of the first ring segment complementarily engages the second support surface of the second spacer member.

22. The method according to claim 17, wherein the rail interface of the firearm is a Picatinny or Weaver rail interface.

23. The method according to claim 17, wherein the device is an optical device.

24. The method according to claim 17, wherein the second ring segment has a mounting base oppositely-disposed relative to the cradle surface thereof, the mounting base has a supplemental rail interface facing away from the ring assembly, and the method further comprises mounting a second device to the supplemental rail interface.

* * * * *